US007887079B2

(12) United States Patent
Krafft

(10) Patent No.: US 7,887,079 B2
(45) Date of Patent: Feb. 15, 2011

(54) GLIDING BOARD FOR SNOW

(75) Inventor: Bertrand Krafft, Brison Saint-Innocent (FR)

(73) Assignee: Salomon S.A.S., Metz-Tessy (FR)

( * ) Notice: Subject to any disclaimer, the term of this patent is extended or adjusted under 35 U.S.C. 154(b) by 215 days.

(21) Appl. No.: 11/858,559

(22) Filed: Sep. 20, 2007

(65) Prior Publication Data

US 2008/0073875 A1 Mar. 27, 2008

(30) Foreign Application Priority Data

Sep. 22, 2006 (FR) ..... 06 08326

(51) Int. Cl.
*A63C 5/07* (2006.01)

(52) U.S. Cl. ..... 280/602; 280/608; 280/609

(58) Field of Classification Search ..... 280/601, 280/602, 607–611
See application file for complete search history.

(56) References Cited

U.S. PATENT DOCUMENTS

| | | | | |
|---|---|---|---|---|
| 3,326,564 | A * | 6/1967 | Heuvel | 280/602 |
| 4,509,771 | A * | 4/1985 | Nussbaumer | 280/609 |
| 4,919,447 | A * | 4/1990 | Jackson et al. | 280/604 |
| 5,141,243 | A * | 8/1992 | Meatto | 280/602 |
| 6,082,747 | A * | 7/2000 | Parmentier | 280/14.22 |
| 6,406,054 | B1 | 6/2002 | Huyghe | |
| 7,213,828 | B2 * | 5/2007 | Riepler et al. | 280/609 |
| 7,344,148 | B2 * | 3/2008 | Donze et al. | 280/602 |
| 2004/0026893 | A1 | 2/2004 | Donze | |
| 2005/0006875 | A1 * | 1/2005 | Donze et al. | 280/602 |

FOREIGN PATENT DOCUMENTS

| | | | |
|---|---|---|---|
| EP | 1 297 869 | A1 | 4/2003 |
| FR | 2 781 686 | A1 | 2/2000 |
| FR | 2 794 374 | A1 | 12/2000 |
| WO | WO 02/40115 | A1 | 5/2002 |
| WO | WO 2006/049508 | A1 | 5/2006 |

* cited by examiner

*Primary Examiner*—J. Allen Shriver, II
*Assistant Examiner*—Erez Gurari
(74) *Attorney, Agent, or Firm*—Greenblum & Bernstein, P.L.C.

(57) ABSTRACT

A gliding board having a front end and a rear end, the front end and the rear end being spaced from one another along a longitudinal axis, the board being made by superimposing the following elements: a gliding sole; at least one lower reinforcement; at least one upper reinforcement; an intermediate structure, positioned between at least one lower reinforcement and the at least one upper reinforcement; wherein, at least on of the ends of the gliding board, at least one lower reinforcement and/or the at least one upper reinforcement respectively include/each include a longitudinal slit so that in a zone of at least one of the ends there is a reduced reinforcement thickness above and/or below the intermediate structure.

27 Claims, 5 Drawing Sheets

GLIDING BOARD FOR SNOW

CROSS-REFERENCE TO RELATED APPLICATION

This application claims priority under 35 U.S.C. §119 of French Patent Application No. 06.08326, filed on Sep. 22, 2006, the disclosure of which is hereby incorporated by reference thereto in its entirety.

BACKGROUND OF THE INVENTION

1. Field of the Invention

The invention relates to the field of gliding boards and, more particularly, to gliding boards for snow, such as snow skis, i.e., configured to support a single foot of a skier, or snowboards, i.e., configured to support both feet of a rider.

2. Description of Background and Other Information

Gliding boards are known to comprise several components assembled to one another by means of various techniques such as gluing, welding, or injection molding.

Conventionally, a gliding board comprises a top, a gliding surface, also referred to as the sole, at least one upper reinforcement, at least one lower reinforcement, and an intermediate structure sandwiched between the lower reinforcement and the upper reinforcement. The patent document FR 2 781 686 and U.S. Pat. No. 6,406,054, disclose a ski of such type, whereby the intermediate structure, i.e., the core in this case, is made as a one-piece element.

The choice of materials makes it possible to control the behavior of the gliding board. For example, each of the reinforcement materials has specific properties. Therefore, it is known that a ski with aluminum reinforcements, or reinforcement layers, has a soft contact with the snow, and that it dampens the profile of the ski. Such a ski is powerful and rests well on the snow. It is particularly adapted for the practice of downhill skiing or giant slalom skiing.

On the other hand, a ski with fiber reinforcements is quick, responsive, and resilient. A ski of this type is particularly adapted for moguls or for series of short turns.

Further, the shape of the gliding board also determines its behavior. Since skis having curved sidecuts, such as the so-called carving skis, have been introduced, the ski ends (shovel, tail) have gotten wider, which has resulted in poor behavior at the ski ends. Indeed, in some cases, the ends can vibrate, misguide, or entrap inexperienced skiers, depending upon the snow and the terrain.

SUMMARY OF THE INVENTION

The present invention provides a gliding board which overcomes the limitations of the known devices of the prior art and, in particular, the invention provides a gliding board having improved behavioral characteristics.

A gliding board of the invention has a front end and a rear end that are spaced from one another along a longitudinal axis, the board being made by superimposing the following elements: a gliding sole, at least one lower reinforcement, at least one upper reinforcement; an intermediate structure positioned between the at least one lower reinforcement and the at least one upper reinforcement. In addition, at least at one of the ends of the gliding board, the at least one lower reinforcement and/or the at least one upper reinforcement comprises/respectively comprise a longitudinal slit so that, in a zone of the at least one of the ends, there is a reduced reinforcing thickness above and/or below the intermediate structure.

In a particular embodiment, slits are arranged in, and completely traverse, the thickness of both the lower reinforcement and the upper reinforcement. As a result, in the zone of the at least one of the ends of the board, the intermediate structure is not sandwiched between a portion of the at least one lower reinforcement and of the at least one upper reinforcement.

In a particular embodiment, in the area of this zone, there is a continuity of the intermediate structure in the transverse direction. This continuity can be achieved because the intermediate structure comprises a unitary core or because the intermediate structure comprises a rigid, vertical compression-resistant core and a connecting element made of a material that is distinct from the remainder of the core, which is arranged in the zone and can be flexed transversely.

In a particular embodiment of the invention, the rigid core comprises, in an area of this zone, a slit that is opposite the slits arranged in the lower and upper reinforcements. In this case, the dimensions, namely the length and width, of the slit arranged in the rigid core, are greater than those of the slits arranged in the lower and upper reinforcements. This slit is completely filled by the connecting element whose outer dimensions are identical to those of the slit.

In a particular embodiment, the connecting element is made of a rubber type of material or an elastic type of material.

In a first embodiment of the invention, the slit arranged in the lower reinforcement as well as the slit arranged in the upper reinforcement are equivalent (having substantially the same lengths and widths) and are positioned strictly one on top of the other.

In other embodiments, multiple alternatives are possible; the length Lo.i.1 of the lower slit of the lower reinforcement can be greater or shorter than the length Lo.s.1 of the upper slit of the upper reinforcement. Similarly, the width La.i.1 of the lower slit of the lower reinforcement can be greater or smaller than the width La.s.1 of the upper slit of the upper reinforcement.

BRIEF DESCRIPTION OF THE DRAWINGS

The invention will be better understood from the following description, with reference to the attached drawings, and in which.

BRIEF DESCRIPTION OF THE INVENTION

Figure 1:
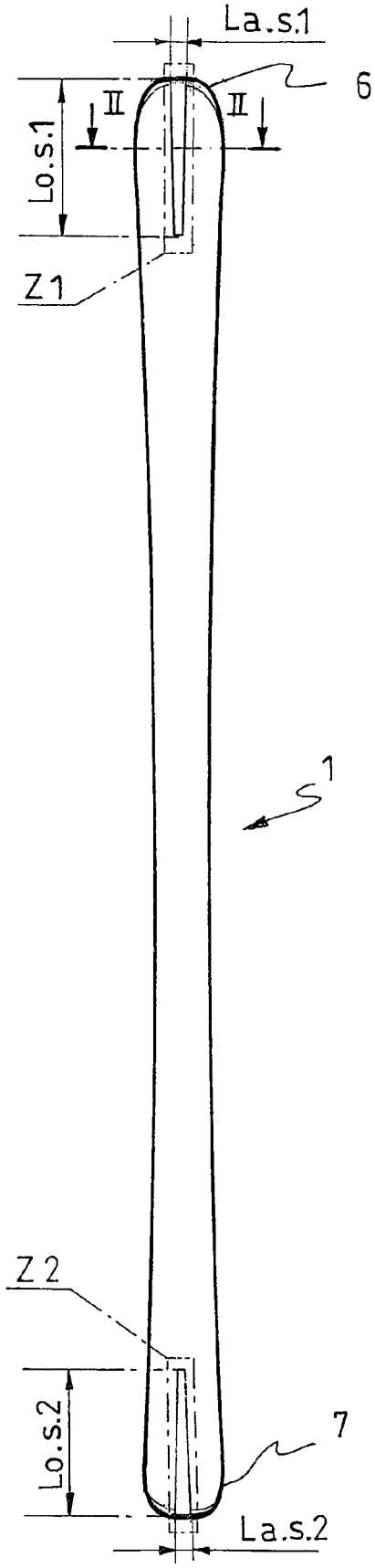
FIG. 1 is a top view of a gliding board according to a first embodiment of the invention.

FIG. 1 shows a top view of a gliding board 1 according to a first embodiment of the invention. The gliding board, here shown as a ski, includes a front end 6, or shovel, and a rear end 7, or tail. The gliding board is made by superimposing a gliding sole 2; a lower reinforcement/reinforcing layer 4; an upper reinforcement/reinforcing layer 3, an intermediate structure 5 positioned between the at least one lower reinforcement 4 and the at least one upper reinforcement 3; and a top layer 11 covering it all. The intermediate structure is mostly made up of a core. The core is made of a rigid material that sufficiently resists vertical compression so that, when sandwiched between the lower reinforcement and the upper reinforcement, it provides the gliding board with adequate rigidity. This material can be wood, polyurethane, or any equivalent material, for example. In a zone Z1 of the front end 6 and in a zone Z2 of the rear end 7, the intermediate structure 5 is not sandwiched between the upper reinforcement 3 and the lower reinforcement 4. More precisely described, in the zone Z1 and/or in the zone Z2, the intermediate structure 5 is not sandwiched between the upper reinforcement 3 and the lower reinforcement 4 the same way it is in the remainder of the gliding board. In other words, the slits that are arranged in the reinforcements can similarly be replaced by weakening structures such as, for example, reductions of thicknesses or mere notches.

In the zone Z1 and in the zone Z2, the top layer 11 has a slit with a length Lo.s.1 and Lo.s.2, respectively. At the front of the gliding board, in the zone Z1, the length Lo.s.1 of the slit is comprised between 150 mm and 400 mm, in one embodiment, and between 200 mm and 350 mm in another embodiment. In particular, good results have been achieved with a slit in the front area Z1 having a length of about 300 mm. The length of the slit is measured from the tip of the board, whether it is covered or not, or even extended by a plastic end piece.

At the rear of the gliding board, in the zone Z2, the length Lo.s.2 of the slit is comprised between 20 mm and 200 mm in one embodiment and between 50 mm and 180 mm in another embodiment. In particular, good results have been achieved with a rear slit whose length Lo.s.2 is about 150 mm.

Figure 2:
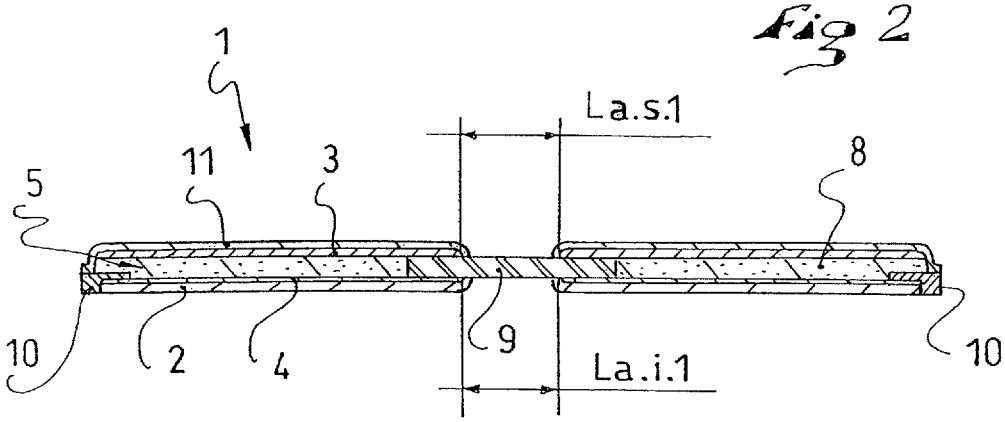
FIG. 2 is a cross-sectional view of the gliding board of FIG. 1, taken along line II-II of FIG. 1.

FIG. 2 shows a transverse cross-sectional view of the front end 6 of the gliding board. In the area of this cross section, the lower reinforcement 4 and the upper reinforcement 3 both comprise two portions separated by a slit. The upper slit arranged in the upper reinforcement 3 has a width La.s.1, which is equal to the width La.i.1 of the lower slit arranged in the lower reinforcement 4. This common width is comprised between 5 mm and 30 mm in one embodiment and between 7 mm and 20 mm in another embodiment. Good results have been achieved with a slit in the lower reinforcement 4 with a width La.i.1 of about 10 mm.

As previously described, the slits could be replaced by weakened areas, such as, for example, thickness reductions in the reinforcements.

The intermediate structure 5 comprises a core 8 whose front and rear ends each include a slit. The slit located at its front end is shown in FIG. 2. This slit extends vertically, i.e., along the thickness of the board, through the entirety of the core 8. Its dimensions (width, length) are greater than those of the slits arranged in the lower reinforcement and in the upper reinforcement. The intermediate structure 5 also comprises a connecting element 9, which fills the space left free by the slit arranged in the core 8. The connecting element 9, in the illustrated embodiment, consists of a block made of rubber or any equivalent material, such as an elastomer, having the same thickness as that of the core, and dimensions such that it can be inserted in the slit arranged therein.

In the zone Z1, the intermediate structure 5 is continuous in the transverse direction of the intermediate structure 5, the lower reinforcement 4 and the upper reinforcement 3 are each discontinuous. In other words, in the zone Z1, the intermediate structure 5 is not sandwiched between the upper reinforcement 3 and the lower reinforcement 4.

The gliding board also comprises a gliding sole 2 positioned beneath the lower reinforcement 4, metallic running edges 10, and a top 11, or cap, positioned on the upper reinforcement 3.

As is the case in the lower reinforcement 4, a slit is cut in the gliding sole 2. This slit of the sole is slightly narrower than the slit provided in the lower reinforcement, so that the edges of the sole surrounding the slit of the sole cover the edges of the lower reinforcement surrounding the slit of the lower reinforcement, thus providing waterproofness to the lower surface of the gliding board.

Similarly, a slit, i.e., a top slit, is provided in the top 11. This slit is slightly narrower than that provided in the upper reinforcement 3. Thus, in the area of the slit, the edges of the top 11 cover the edges of the upper reinforcement 3, thereby providing waterproofness to the upper surface of the gliding board.

If a cross-section were to be made in the rear end of the gliding board, a construction similar to that shown in FIG. 2 could be seen, with, in zone Z2, a discontinuity of the upper reinforcement 3, the latter having a slit with a width La.s.2 and a length Lo.s.2, and a discontinuity of the lower reinforcement 4, the latter having a slit with a width La.i.2 and a length Lo.i.2.

Figure 3:
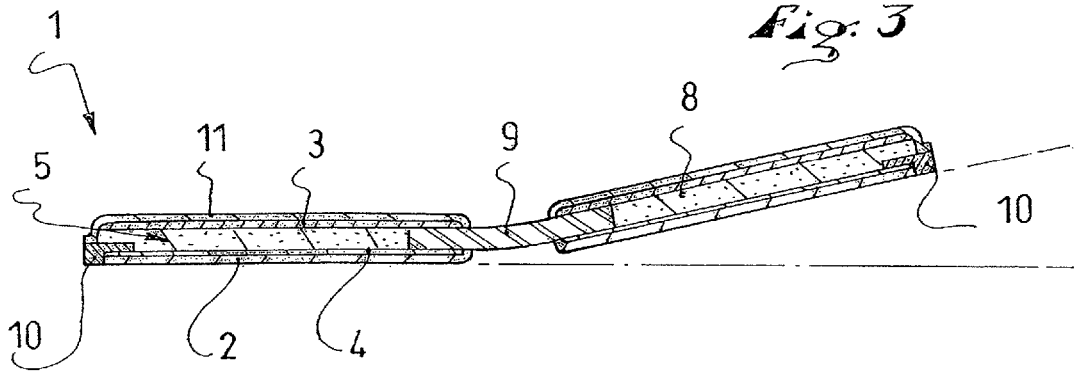
FIG. 3 is a cross-sectional view of the gliding board of FIG. 1, similar to that of FIG. 2.

The two slits provided in the ski, one at the front and one at the rear, make it possible in a way to unlock the two ends, which have become too rigid due to their increased width. FIG. 3, in a transverse cross-sectional view similar to that of FIG. 2, shows the new behavior of the gliding board made possible by the construction of the gliding board according to the invention. The discontinuity of the lower and upper reinforcements brings about suppleness, a certain flexibility along a transverse direction. Moreover, the connecting element 9 ensures a continuity of the gliding board structure, especially in terms of longitudinal flexional properties.

A gliding board slit according to the invention makes it easier for the user to slide and control/maneuver. The drawbacks of gliding boards with curved sidecuts and short radii of curvature, that is, less than 15 meters, are substantially minimized.

In general, the gliding boards made according to the invention are very progressive, uniform in curvature, accessible, and particularly forgiving and easy to maneuver. In addition, such gliding boards are very stable on flat terrain while their ends are very soft on bumps.

Figure 4:
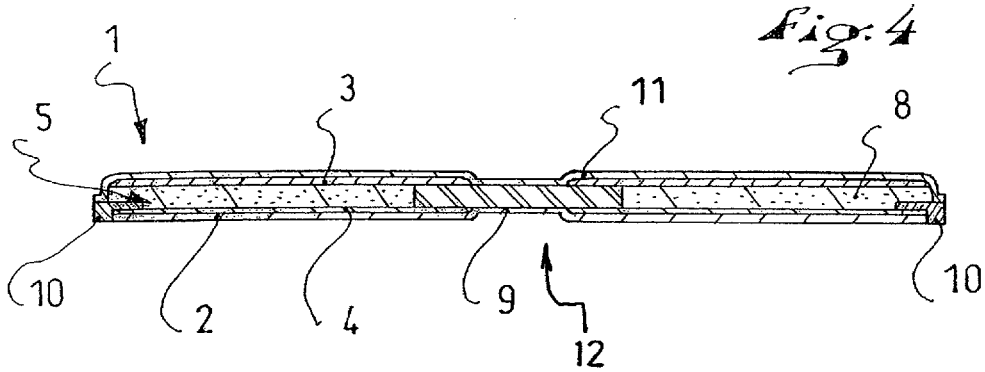
FIG. 4 is a cross-sectional view of a gliding board according to a second embodiment of the invention.

FIG. 4 shows a cross-section of a second embodiment of the invention. As in the first embodiment, the gliding board is made by superimposing a gliding sole 2, a lower reinforcement 4, an upper reinforcement 3, and an intermediate structure 5 positioned between the at least one lower reinforcement 4 and the at least one upper reinforcement 3. The intermediate structure 5 is mostly made of a core 8 completed by a connecting element 9 in a zone Z1 of the front end 6, and in a zone Z2 of the rear end. In these zones Z1 and Z2, the intermediate structure 5 is not sandwiched between the upper reinforcement 3 and the lower reinforcement 4.

FIG. 4 shows a transverse cross section of the front end 6 of the gliding board. In the following description, only the front end of the board, and therefore zone Z1, will be featured. Everything described is also true for the rear end and the zone Z2.

In the area of this cross section, the lower reinforcement 4 and the upper reinforcement 3 both comprise two portions separated by a slit. The upper slit arranged in the upper reinforcement 3 has a width La.s.1 which is equal to the width La.i.1 of the lower slit arranged in the lower reinforcement 4.

Unlike in the previous embodiment, the top layer 11 does not comprise a slit. In the zone Z1, the top layer 11 rests directly on the connecting element 9. The zone Z1 is visually materialized by a portion of the top layer that is slightly set back with respect to the remainder of the upper surface of the gliding board. The depth of this set back zone is determined by the thickness of the upper reinforcement 3.

It is however possible to eliminate this set back portion by filling up the slit arranged in the upper reinforcement 3 with a wedge (not shown), or spacer, or else to increase the depth of the set back portion by providing a top layer 11 that is thinner in the zone Z1 than in the remainder of the upper surface.

The gliding sole 2 does not comprise a slit either. In the zone Z1, the gliding sole is directly in contact with the connecting element 9. However, in the zone Z1, the sole has a lesser thickness, so that the groove 12 visible in the sole has a depth that is greater than the thickness of the lower reinforcement 4. In case one would want to make the groove even more visible, the gliding sole could be made in several portions, the portion positioned at the bottom of the groove having a different color than that of the remainder of the sole.

Advantageously, when the top layer 11 and the gliding sole do not have a slit, the construction of the ski is simplified. Indeed, in this case, the ski waterproofness in the area of the slit is obtained more easily.

The gliding boards hereinabove described are boards whose slit, arranged in the upper reinforcement at the front and at the rear, respectively, has the same length as that arranged in the lower reinforcement at the front and at the rear, respectively. This is not a limiting characteristic of the invention, and it is possible to have boards in which the upper reinforcement slit is different from the lower reinforcement slit with respect to length, size and/or shape.

Figure 5:
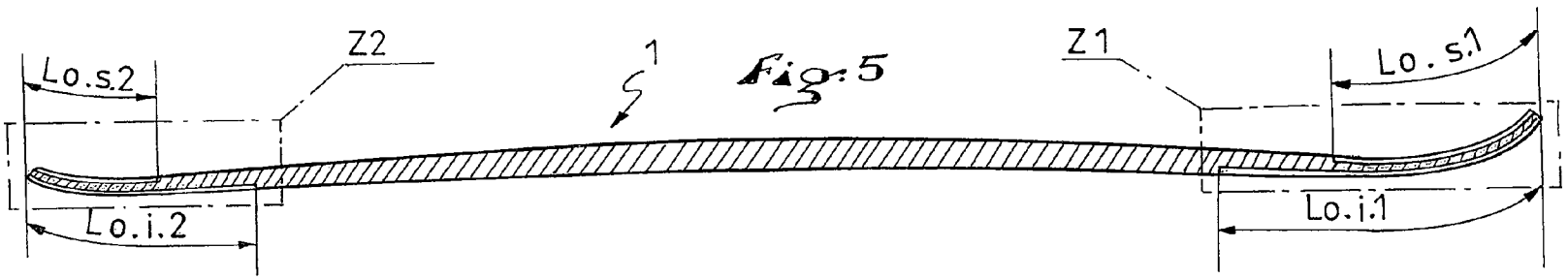
FIG. 5 is a simplified longitudinal cross-sectional view of a gliding board according to a third embodiment of the invention, taken along line V-V of FIG. 6.
Figure 6:
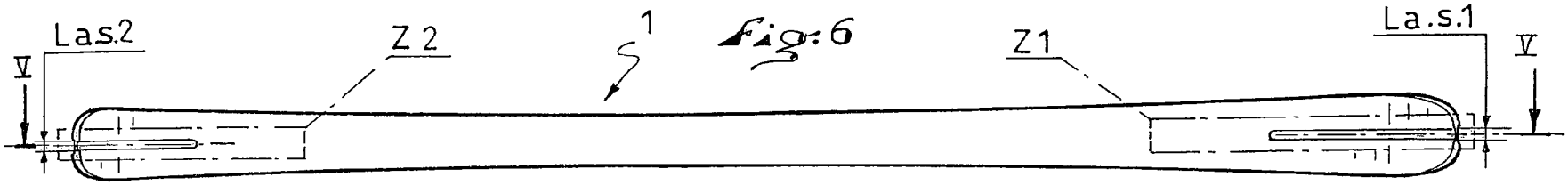
FIG. 6 is a top view of the gliding board of FIG. 5.
Figure 7:
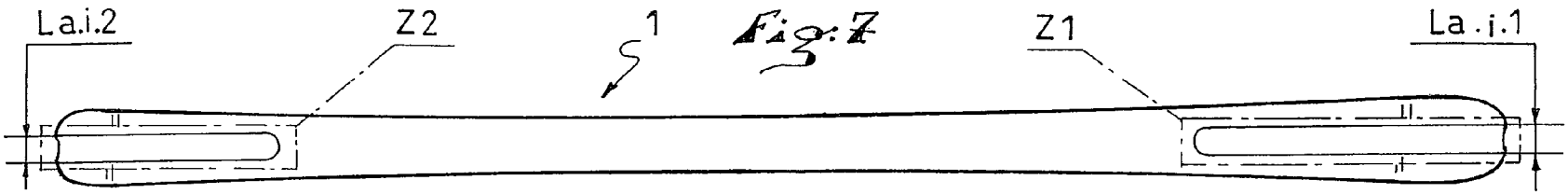
FIG. 7 is a bottom view of the gliding board of FIG. 5.
Figure 8:
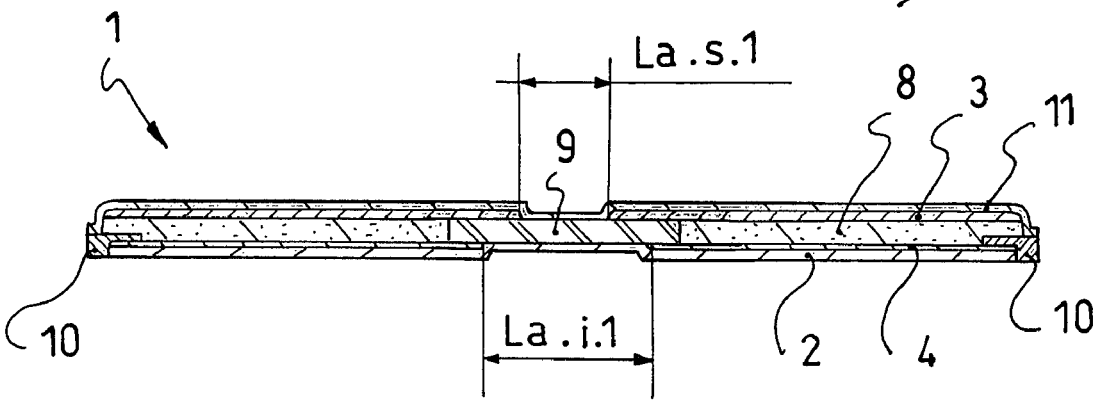
FIG. 8 is a transverse cross-sectional view of the gliding board of FIG. 6.

FIGS. 5, 6, 7, and 8 illustrate a third embodiment of the invention. FIGS. 5, 6, and 7, show a simplified longitudinal cross-sectional view, a top view and a bottom view, respectively, whereas FIG. 8 shows a transverse cross-section.

The gliding board 1 is made by superimposing a gliding sole 2, a lower reinforcement 4, an upper reinforcement 3, and an intermediate structure 5, positioned between the at least one lower reinforcement 4 and the at least one upper reinforcement 3. The intermediate structure 5 is mostly made of a core 8 completed by a connecting element 9 in a zone Z1 of the front end 6, and in a zone Z2 of the rear end. In these zones Z1 and Z2, the intermediate structure 5 is not sandwiched between the upper reinforcement 3 and the lower reinforcement 4.

The gliding board also comprises a top 11, or cap, and running edges 10 positioned on both sides of the gliding sole 2. In the chosen construction, the top 11 rests directly on the running edges 10. This is not a limiting characteristic of the invention, which can also be made with edges intercalated between the running edges and the top.

At the front end of the board, that is, in the area of the shovel, a zone Z1 is defined in which the upper reinforcement 3 has a slit with a length Lo.s.1 and a width La.s.1. In the same zone Z1, the lower reinforcement 4 has a slit with a length Lo.i.1 and a width La.i.1.

The length Lo.s.1 of the slit of the upper reinforcement is smaller than the length Lo.i.1 of the slit of the lower reinforcement, whereas the width La.s.1 is also smaller than the width La.i.1 of the slit of the lower reinforcement.

Similarly, at the rear end of the board, that is, in the heel area, a zone Z2 is defined in which the upper reinforcement 3 has a slit with a length Lo.s.2 and a width La.s.2. In the same zone Z2, the lower reinforcement 4 has a slit with a length Lo.i.2 and a width La.i.2.

The length Lo.s.2 of the slit of the upper reinforcement is smaller than the length Lo.i.2 of the slit of the lower reinforcement, whereas the width La.s.2 is also smaller than the width La.i.2 of the slit of the lower reinforcement.

Figure 9:
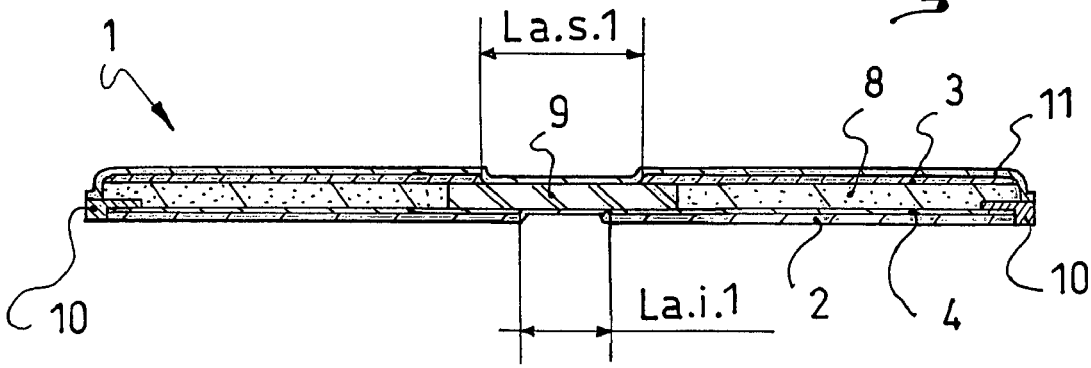
FIG. 9 is a transverse cross-sectional view of a gliding board according to a fourth embodiment of the invention.

Any combination of the different lengths and widths of the slits in zones Z1 and Z2 is possible. Thus, FIG. 9 shows a transverse cross-section similar to that of FIG. 8 of a fourth embodiment of the invention in which the width La.s.1 of the slit of the upper reinforcement is wider than the width La.i.1 of the slit of the lower reinforcement.

Figure 10A:
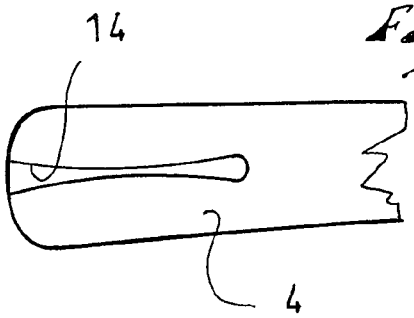
FIGS. 10*a*, 10*b*, 10*c*, 10*d* show alternative embodiments.
Figure 10B:
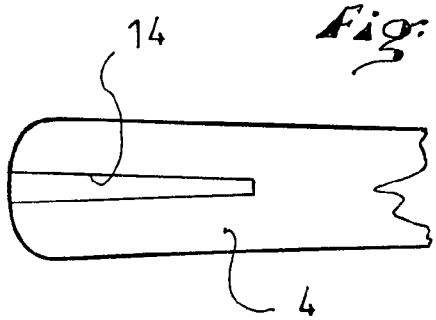
Figure 10C:
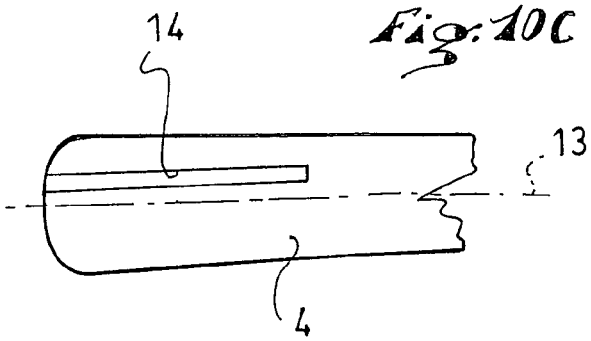
Figure 10D:
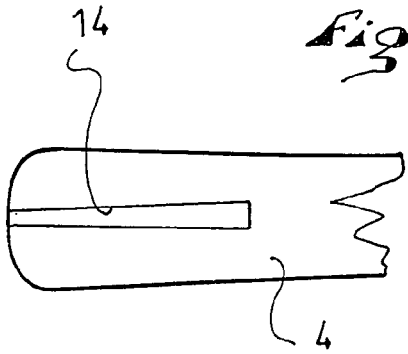

Similarly, although the first four embodiments of the invention described hereinabove relate to gliding boards whose reinforcements have rectangular slits positioned along the median axis of the gliding board, the invention is not limited to these possibilities. Further, FIGS. 10*a*, 10*b*, 10*c*, and 10*d* show alternate embodiments. Without analyzing the detail of the complete assembly of the corresponding gliding boards, FIGS. 10*a*, 10*b*, and 10*d* show a partial top view of the lower reinforcements 4 having a slit 14 with a "wasp waist-shape" (10*a*), a straight trapezoidal shape (10*b*), and an inverted trapezoidal shape (10*d*), respectively. FIG. 10*c* shows a lower reinforcement 4 whose slit 14 is not positioned along the median axis 13 of the gliding board.

The gliding boards hereinabove described comprise a slit in the front zone Z1 and a slit in the rear zone Z2. Gliding boards according to the invention can be envisioned with a slit only in the front zone Z1, for example to make a performance type of ski, or only in the rear zone Z2, for example to make a freeride type of ski.

The present invention is not limited to the several embodiments hereinabove described by way of example, but rather covers any equivalent embodiment. Furthermore, the method for manufacturing the ski has not been mentioned insofar as a ski according to the invention can be made regardless of the method of manufacture selected: gluing, pressing, injection, etc.

LIST OF ELEMENTS

1—gliding board
2—gliding sole
3—upper reinforcement
4—lower reinforcement
5—intermediate structure
6—front end
7—rear end
8—core
9—connecting element
10—running edge
11—top
12—groove
13—median axis
14—slit

The invention claimed is:

1. A gliding board comprising:

a front end and a rear end, said front end and said rear end being spaced apart along a longitudinal axis;

the gliding board further being made by superimposing the following elements:

a gliding sole consisting of a layer comprising a bottom surface of the gliding board;

at least one lower reinforcement positioned above the gliding sole;

at least one upper reinforcement;

an intermediate structure positioned between said at least one lower reinforcement and said at least one upper reinforcement;

at at least one of the ends of the gliding board, said at least one lower reinforcement and/or the at least one upper reinforcement respectively comprise a longitudinal slit so that in a zone of said at least one of the ends there is a reduced reinforcement thickness above and/or below said intermediate structure;

the intermediate structure comprising a rigid core and a connecting element made of a different material than the remainder of the core, the connecting element being positioned in said zone and is transversely flexible;

said connecting element having a width that is larger than a width of said slit.

2. A gliding board according to claim 1, wherein:

in the area of said zone there is a continuity of the intermediate structure in the transverse direction.

3. A gliding board according to claim 1, wherein:

said lower reinforcement comprises a lower slit with a length Lo.i.1;

the upper reinforcement comprises an upper slit with a length Lo.s.1; and

Lo.i.1 is greater than Lo.s.1.

4. A gliding board according to claim 1, wherein:

said lower reinforcement comprises a lower slit with a length Lo.i.1;

said upper reinforcement comprises an upper slit with a length Lo.s.1; and

Lo.i.1 is less than Lo.s.1.

5. A gliding board according to claim 1, wherein:

said lower reinforcement comprises a lower slit with a width La.i.1;

said upper reinforcement comprises an upper slit with a width La.s.1; and

La.i.1 is greater than La.s.1.

6. A gliding board according to claim 1, wherein:

the intermediate structure comprises a unitary core.

7. A gliding board according to claim 1, wherein:

at least one of the slits is arranged in and completely traverses one of the reinforcements.

8. A gliding board according to claim 1, wherein:

a slit is provided in said core;

said slit is filled by said connecting element so as to ensure the continuity of the intermediate structure.

9. A gliding board according to claim 8, wherein:

said connecting element is made of rubber or an equivalent material.

10. A gliding board according to claim 1, wherein:

at both of the ends of the gliding board, said at least one lower reinforcement and/or said at least one upper reinforcement respectively comprise a longitudinal slit so that in a zone of said at least one of the ends there is a reduced reinforcement thickness above and/or below said intermediate structure.

11. A gliding board according to claim 1, wherein:

at both of the ends of the gliding board, said at least one lower reinforcement and said at least one upper reinforcement respectively comprise a longitudinal slit so that in a zone of said at least one of the ends there is a reduced reinforcement thickness above and below said intermediate structure.

12. A gliding board comprising:

a pair of longitudinally spaced apart ends comprising:

a forwardmost tip;

a rearwardmost tail;

a front section including a shovel extending longitudinally forwardly to the tip;

a rear section spaced rearwardly from said shovel, said rear section extending longitudinally to the tail;

an intermediate section extending longitudinally between the front section and the rear section;

the front section, the rear section, and the intermediate section each including superimposed components as follows:

a gliding sole providing a bottom surface of the gliding board;

a top layer;

an intermediate structure including a compression-resistant core;

a lower reinforcement structure positioned below the intermediate structure and above the gliding sole, said lower reinforcement structure having a transversely extending width and a thickness, said lower reinforcement structure comprising at least one lower reinforcement layer;

an upper reinforcement structure positioned above the intermediate structure and below the top layer, said upper reinforcement structure having a transversely extending width and a thickness, said upper reinforcement structure comprising at least one upper reinforcement layer;

at least one of the front section and the rear section encompassing the following:

a longitudinally extending zone extending to one of said ends, said longitudinally extending zone having a width less than a width of the gliding board;

at least one of the lower reinforcement structure and the upper reinforcement structure being weakened within said longitudinally extending zone compared to outside said longitudinally extending zone;

the intermediate structure further comprising a connecting element interposed width-wise within a vertical slit in said compression-resistant core, said connecting element and said core providing the intermediate structure with width-wise continuity;

the core and the connecting element being made of different materials, the connecting element not being compression-resistant;

the connecting element having a width that is larger than a width of said zone.

13. A gliding board according to claim 12, wherein:

said superimposed components for a cap construction for the gliding board, said top layer extending across a top of the gliding board and continuously extending from said top of the gliding board down along opposite sides of the gliding board.

14. A gliding board comprising:

a pair of longitudinally spaced apart ends comprising:

a forwardmost tip;

a rearwardmost tail;

a front section including a shovel extending longitudinally forwardly to the tip;

a rear section spaced rearwardly from said shovel, said rear section extending longitudinally to the tail;

an intermediate section extending longitudinally between the front section and the rear section;

a side cut radii of less than 15 meters;

the front section, the rear section, and the intermediate section each including superimposed components as follows:

a gliding sole providing a bottom surface of the gliding board;

a top layer;

an intermediate structure including a compression-resistant core;

the intermediate structure further comprises a connecting element interposed width-wise within a vertical slit in said compression-resistant core, said connecting element and core providing the intermediate structure with width-wise continuity;

the core and the connecting element are made of different materials, the connecting element not being compression-resistant, the core and the connecting element having identical thicknesses;

a lower reinforcement structure positioned below the intermediate structure and above the gliding sole, said lower reinforcement structure having a transversely extending width and a thickness, said lower reinforcement structure comprising at least one lower reinforcement layer;

an upper reinforcement structure positioned above the intermediate structure and below the top layer, said upper reinforcement structure having a transversely extending width and a thickness, said upper reinforcement structure comprising at least one upper reinforcement layer;

at least one of the front section and the rear section encompassing the following:

a longitudinally extending zone extending to one of said ends, said longitudinally extending zone having a width less than a width of the gliding board;

at least one of the lower reinforcement structure and the upper reinforcement structure being weakened within said longitudinally extending zone compared to outside said longitudinally extending zone.

15. A ski comprising:

a pair of longitudinally spaced apart ends comprising:

a forwardmost tip;

a rearwardmost tail;

a front section including a shovel extending longitudinally forwardly to the tip;

a rear section spaced rearwardly from said front section, said rear section extending longitudinally to the tail;

an intermediate section extending longitudinally between the front section and the rear section;

the front section, the rear section, and the intermediate section each including superimposed components as follows:

a gliding sole providing a bottom surface of the ski;

a top layer;

an intermediate structure including a compression-resistant core;

a lower reinforcement structure positioned below the intermediate structure and above the gliding sole, said lower reinforcement structure having a transversely extending width and a thickness, said lower reinforcement structure comprising at least one lower reinforcement layer;

an upper reinforcement structure positioned above the intermediate structure and below the top layer, said upper reinforcement structure having a transversely extending width and a thickness, said upper reinforcement structure comprising at least one upper reinforcement layer;

a longitudinally extending front zone extending within the shovel to the tip, said front zone having a width less than a width of the shovel;

a longitudinally extending rear zone extending within the rear section of the ski to the tail, said rear zone having a width less than a width of the rear section;

the lower reinforcement structure and the upper reinforcement structure both having a weakened area, said weakened area of each of the lower and upper reinforcement structures being weakened within said front zone compared to outside said front zone;

the lower reinforcement structure and the upper reinforcement structure both having a weakened area, said weakened area of each of the lower and upper reinforcement structures being weakened within said rear zone compared to outside said rear zone;

the core of at least the rear section comprising a rigid core and a connecting element made of a different material than the remainder of the core, the connecting element being positioned in said rear zone and being transversely flexible;

said connecting element of the rear section having a width that is larger than a width of said weakened area of said rear zone.

16. A ski according to claim 15, wherein:

each of said weakened reinforcement structures of the upper and lower reinforcement structures in the front zone has a length, extending to the tip, of at least 150 mm and no greater than 400 mm;

each of said weakened reinforcement structures of the upper and lower reinforcement structures in the rear zone has a length, extending to the tail, of at least 20 mm and no greater than 200 mm.

17. A ski according to claim 16, wherein:

each of said weakened reinforcement structures of the upper and lower reinforcement structures in the front and rear zones has a width of at least 5 mm and no greater than 30 mm.

18. A ski according to claim 16, wherein:

each of said weakened structures comprises a slit.

19. A ski according to claim 15, wherein:

in each of the front zone and the rear zone, a slit is provided within said compression-resistant core, said slit in the core in respective ones of the front and rear zones is filled with an elastic non-compression resistant material, thereby providing continuity of said intermediate structure within said front and rear zones and outside said front and rear zones.

20. A ski according to claim 16, wherein:

in each of the front zone and the rear zone, a slit is provided within said compression-resistant core, said slit in the core in respective ones of the front and rear zones is filled with an elastic non-compression resistant material, thereby providing continuity of said intermediate structure within said front and rear zones and outside said front and rear zones.

21. A gliding board according to claim 1, further comprising:

side cut radii of less than 15 meters.

22. A gliding board according to claim 12, further comprising:

side cut radii of less than 15 meters.

23. A ski according to claim 15, further comprising:

a side cut radius of less than 15 meters on each of opposite sides of the ski.

24. A gliding board comprising:

a pair of longitudinally spaced apart ends comprising:

a forwardmost tip;

a rearwardmost tail;

a front section including a shovel extending longitudinally forwardly to the tip;

a rear section spaced rearwardly from said shovel, said rear section extending longitudinally to the tail;

an intermediate section extending longitudinally between the front section and the rear section;

the front section, the rear section, and the intermediate section each including superimposed components as follows:

a gliding sole providing a bottom surface of the gliding board;

a top layer;

an intermediate structure including a compression-resistant core;

the intermediate structure further comprises a connecting element interposed width-wise within a vertical slit in said compression-resistant core, said connecting element and core providing the intermediate structure with width-wise continuity;

the core and the connecting element are made of different materials, the connecting element not being compression-resistant, the core and the connecting element having identical thicknesses;

a lower reinforcement structure positioned below the intermediate structure and above the gliding sole, said lower reinforcement structure having a transversely extending width and a thickness, said lower reinforcement structure comprising at least one lower reinforcement layer;

an upper reinforcement structure positioned above the intermediate structure and below the top layer, said upper reinforcement structure having a transversely extending width and a thickness, said upper reinforcement structure comprising at least one upper reinforcement layer;

at least one of the front section and the rear section encompassing the following:

a longitudinally extending zone extending to one of said ends, said longitudinally extending zone having a width less than a width of the gliding board;

at least one of the lower reinforcement structure and the upper reinforcement structure being weakened within said longitudinally extending zone compared to outside said longitudinally extending zone;

said connecting element having a width that is larger than a width of said longitudinally extending zone.

25. A gliding board according to claim 21, wherein:

the gliding board is a snowboard configured to support a rider's feet.

26. A gliding board according to claim 21, wherein:

the gliding board is a snow ski configured to support only a single foot of a skier.

27. A gliding board according to claim 22, wherein:

the compression-resistant core is a unitary compression-resistant core extending width-wise of the gliding board, from outside the width of the zone and entirely through the width of the zone.

* * * * *